US006334544B1

(12) United States Patent
Christensen et al.

(10) Patent No.: US 6,334,544 B1
(45) Date of Patent: Jan. 1, 2002

(54) UPRIGHT NAPKIN DISPENSER

(75) Inventors: James B. Christensen, Green Bay, WI (US); Craig D. Yardley, Deer Park, IL (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/595,267

(22) Filed: Jun. 15, 2000

(51) Int. Cl.[7] ..... B65H 1/00
(52) U.S. Cl. ..... 221/63; 221/303
(58) Field of Search ..... 221/33, 45, 63, 221/303, 312 R, 312 C

(56) References Cited

U.S. PATENT DOCUMENTS 4,491,242 A * 1/1985 Trinidad ..... 221/312 R

* cited by examiner

*Primary Examiner*—David H. Bollinger
(74) *Attorney, Agent, or Firm*—Burns, Doane, Swecker & Mathis, LLP

(57) ABSTRACT

A napkin dispenser includes a housing having upright walls and a floor together forming a vertical compartment for the reception of a vertical stack of horizontal paper napkins. A horizontal slot is formed between the floor and a lower end of a front wall of the housing. That slot communicates with a lower portion of the compartment for facilitating the simultaneous removal of a bunch of napkins from the compartment. The positioning of a user's fingers above and beneath a selected number of napkins to be removed is facilitated by providing a vertical slot extending upwardly from the midpoint of the horizontal slot, and a finger notch formed about midway in a front edge of the floor.

16 Claims, 6 Drawing Sheets

UPRIGHT NAPKIN DISPENSER

BACKGROUND OF THE INVENTION

The present invention relates to upright dispensers for paper napkins.

Conventional paper napkin dispensers used in commercial eating establishments typically comprise a housing forming an internal compartment containing a stack of vertically oriented napkins. A front wall of the housing includes a vertical slot through which the napkins can be pulled one-at-a-time. The napkins can be interfolded wherein a napkin being pulled out will pull out a section or tail of the next napkin to facilitate the sequential dispensing of napkins.

However, on certain occasions it may be desirable to dispense napkins in bunches rather than one-at-a-time. For example, in fast food restaurants having a drive-through window, a restaurant employee bags a customer's food order and then adds one or more napkins to the bag. Depending upon the size of the order, and the number of customers in the vehicle, the employee may want to add a bunch of napkins to the bag.

Removing napkins one-at-a-time from a conventional dispenser to form the bunch is excessively time consuming. Alternatively, a pile of napkins could be placed on a nearby surface from which the employee could remove the napkins in bunches, but besides taking up surface space, such a stack would be susceptible to being knocked over, contaminated, etc.

Therefore, it would be desirable to provide a napkin dispenser that facilitates the removal of napkins selectively in bunches or one-at-a-time. It would also be desirable when removing the napkins in bunches, to be able to select a desired number of napkins.

SUMMARY OF THE INVENTION

The invention relates to a napkin dispenser which includes a housing having upright walls and a floor together forming a vertical compartment for the reception of a vertical stack of horizontal paper napkins. The upright walls include a front wall. A horizontal slot is formed between the floor and a lower end of the front wall, wherein the horizontal slot communicates with a lower portion of the compartment for facilitating the simultaneous removal of a bunch of napkins through the slot.

Preferably, the floor includes a front edge situated below the horizontal slot, the front edge including a recess disposed midway between opposite ends of the slot for facilitating the insertion of a user's finger beneath the bunch of napkins to be removed.

The front wall preferably includes a vertical slot extending upwardly from the horizontal slot at a location midway between opposite ends of the horizontal slot for facilitating the insertion of a user's finger above the bunch of napkins to be removed.

The front edge of the floor is preferably offset inwardly relative to the lower end of the front wall, and the floor preferably includes a ridge extending thereacross parallel to the slot.

Support tabs are preferably attached to the wall structure for engaging an underside of the stack and supporting at least a portion of that underside above the floor.

The invention also pertains to a method of using the dispenser to simultaneously remove a selected number of napkins.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF A PREFERRED EMBODIMENT OF THE INVENTION

Figure 1:
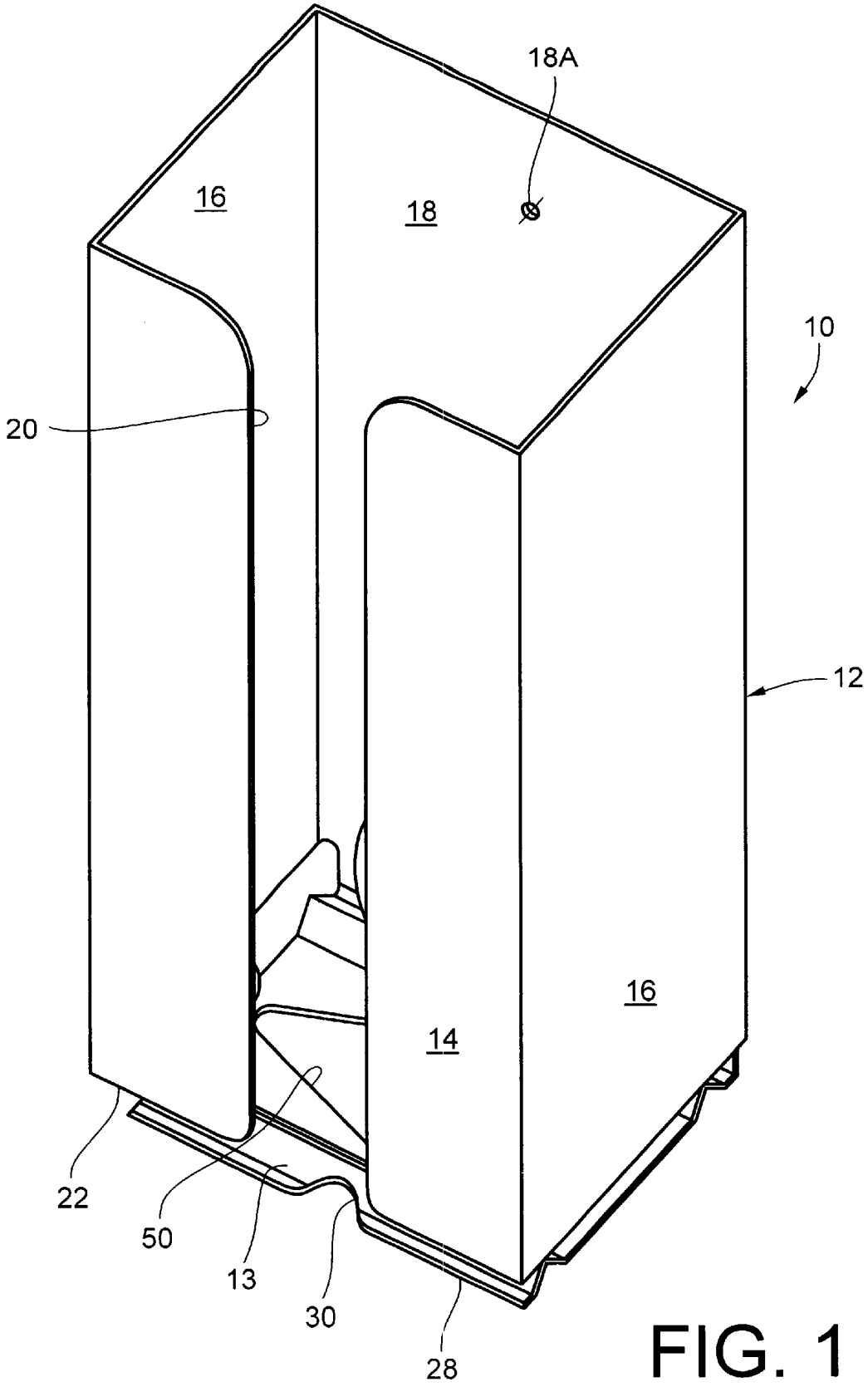
FIG. 1 is a top front perspective view of a napkin dispenser according to the present invention.

A napkin dispenser 10 includes a housing 12 having upright walls and a floor or base 13 forming a vertical compartment 15 for the reception of a vertical stack of horizontal paper napkins N, such as single-folded (2-panel) napkins having dimensions of 6½"×10". The upright walls include a front wall 14, a pair of opposing side walls 16, and a rear wall 18 opposing the front wall.

The rear wall 18 includes holes 18A to accommodate fasteners, such as screws, for example, for securing the housing to a vertical surface (not shown).

Figure 2:
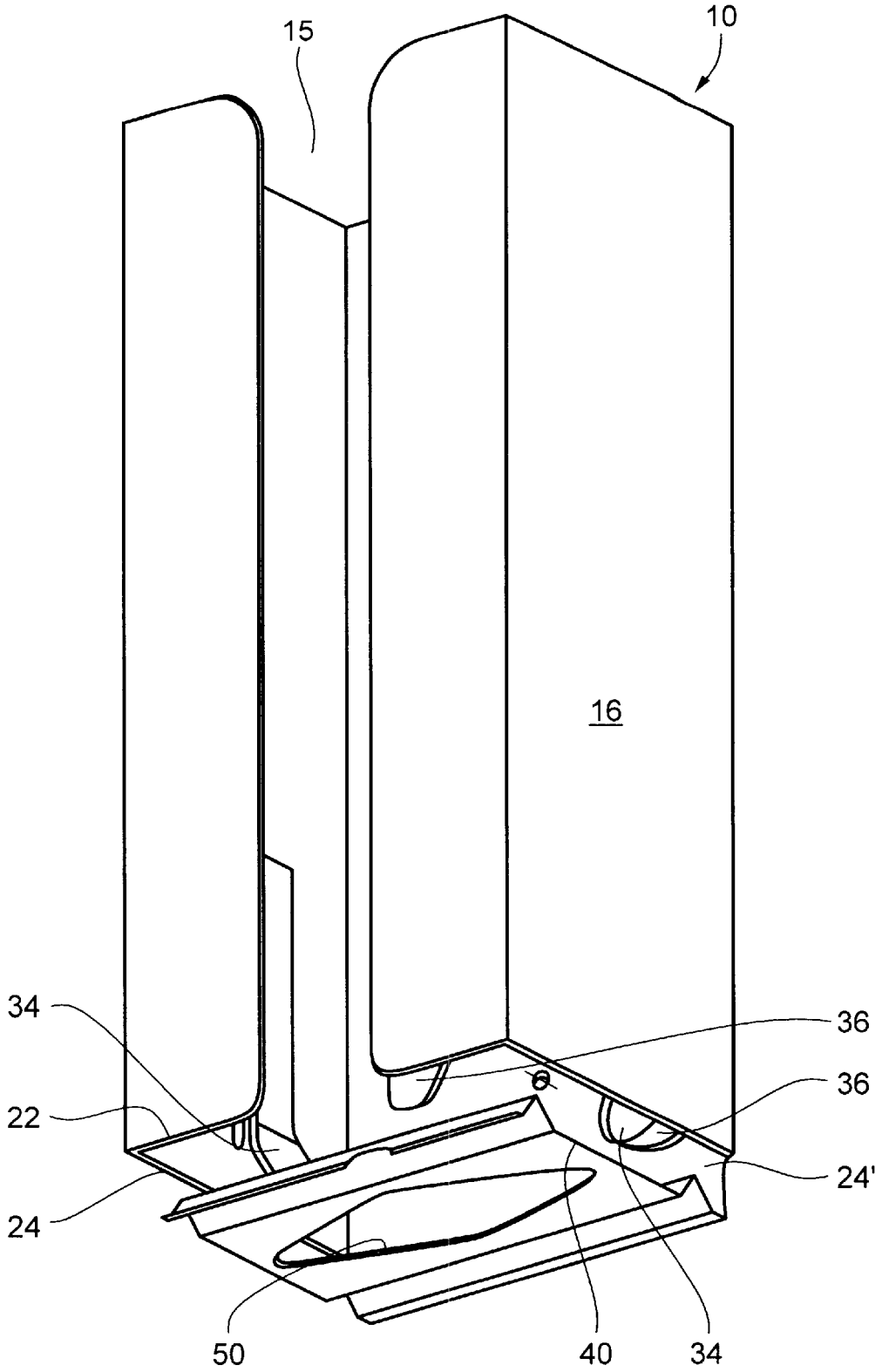
FIG. 2 is a front bottom perspective view of the dispenser.
Figure 3:
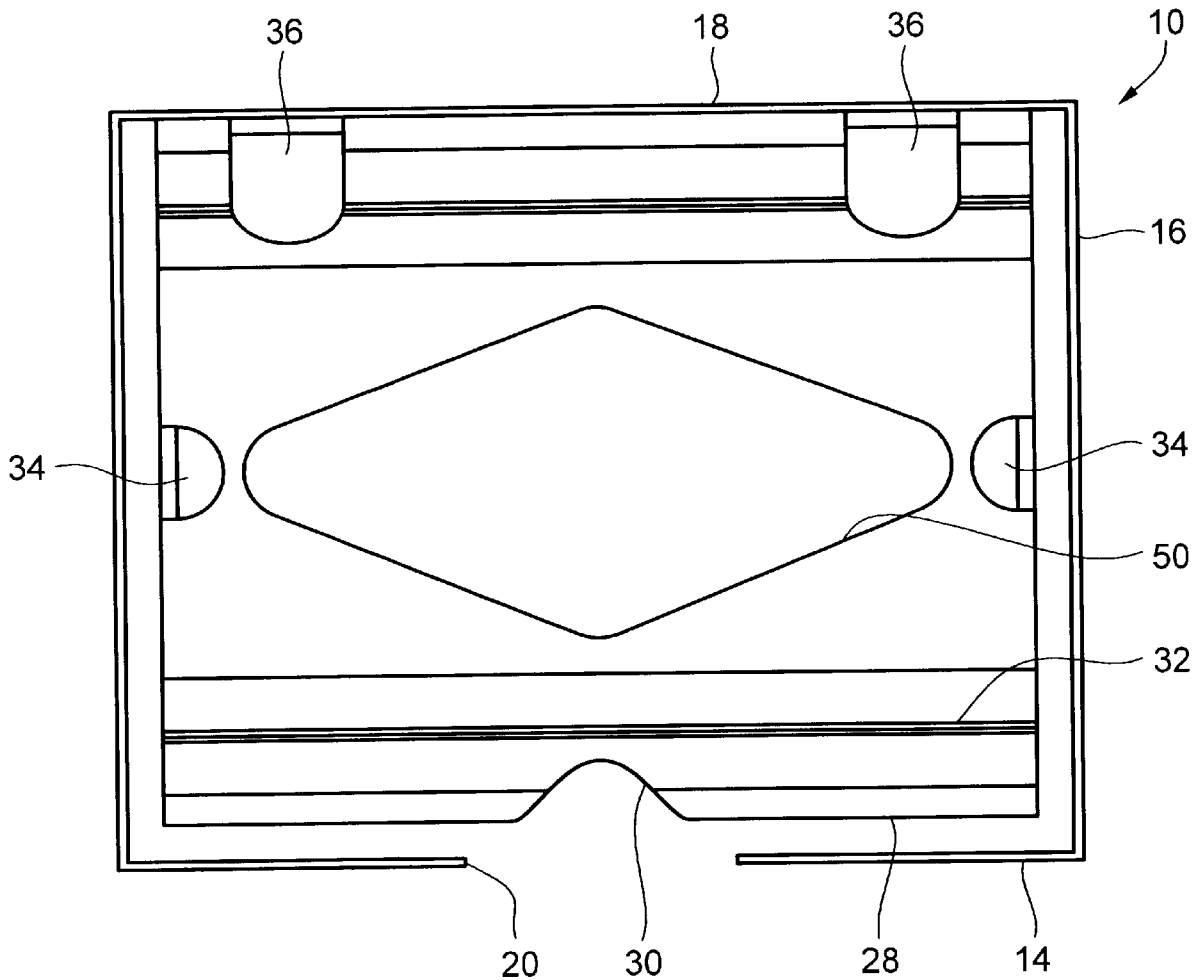
FIG. 3 is a top plan view of the dispenser.

The front wall 14 includes a vertical slot 20 disposed midway between opposite horizontal ends thereof, the slot 20 extending the entire height of the front wall and facilitates loading of the dispenser as well as dispensing by the bunch, as will be explained. A lower end 22 of the front wall is spaced above the floor 13 to form a front horizontal slot 24 therebetween. Thus, the horizontal slot 24 is disposed below the front wall 14, and the lower end 22 of the wall 14 constitutes an upper edge of that horizontal slot 24 (see FIGS. 2 and 4). As will be explained, the slots 24 and 20 are configured to facilitate the removal of napkins in bunches. The lower ends 26 of the side walls 16 are similarly spaced above the floor to form horizontal side extensions 24' of the slot 24 (see FIGS. 2 and 5).

Figure 4:
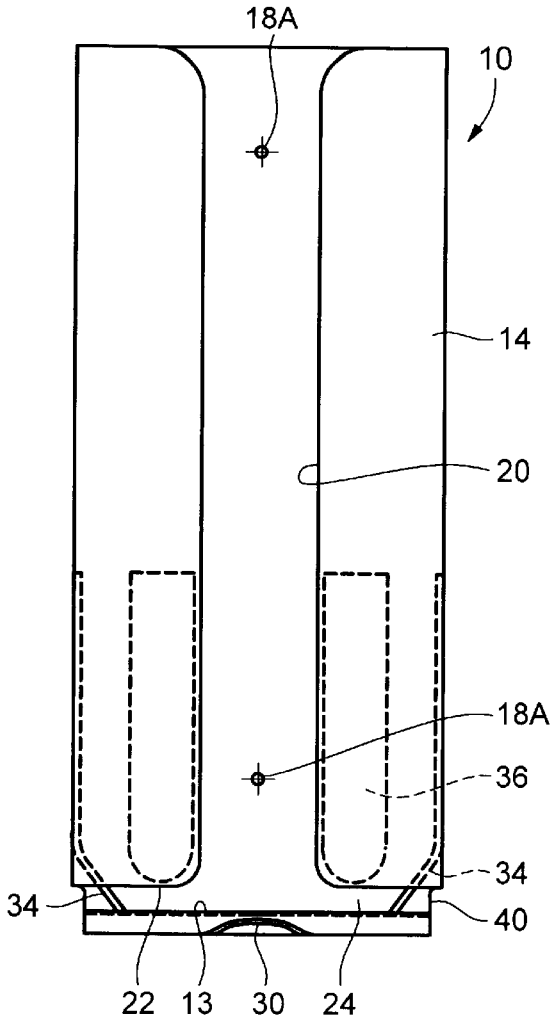
FIG. 4 is a front elevational view of the dispenser.

Formed in a front edge 28 of the floor is a recess 30 or finger notch, the recess located about midway between opposite ends of the front edge, whereby the recess 30 is located in alignment with the vertical slot 20 as the dispenser is viewed from the front (see FIG. 4). The vertical slot 20 and the recess 30 serve to facilitate the positioning of a user's fingers for removing napkins by the bunch, as will be explained.

Figure 7:
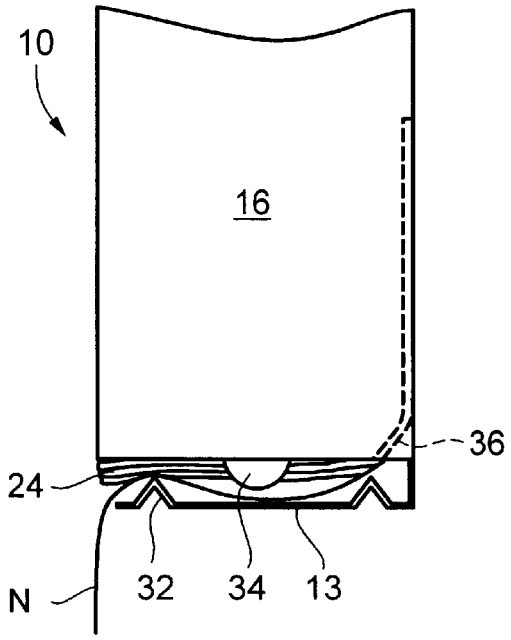
FIG. 7 is a side elevational view of the dispenser with a stack of napkins disposed therein.

The front edge 28 of the floor, in addition to being spaced vertically downwardly from the lower end of the front wall 14, is also offset horizontally inwardly therefrom as can be seen in FIG. 7 for example. Also, the floor includes an upstanding ridge 32 extending horizontally thereacross parallel to the slot 24. The ridge 32 is spaced slightly rearwardly from the front edge 28 of the floor. In addition, a plurality of side support tabs 34 and rear support tabs 36 are provided on the side and rear walls, respectively. The lower end of each tab 34, 36 is bent to project downwardly and inwardly, whereby the tabs form support surfaces that support the underside of the stack of napkins above the floor 13. The rear tabs 36 are situated higher than the side tabs 34 (see FIGS. 4 and 5).

By providing the combination of the ridge 32 and the support tabs 34, 36, wherein the rear support tabs 36 are disposed higher than the side support tabs 34, the front portions of the napkins N located near the bottom of the stack are given a slight downward inclination, (see FIG. 7) which is accommodated by the inward offsetting of the front edge 28 of the floor 13 from the lower end 22 of the front wall. This facilitates the removal of a bunch of napkins through the horizontal slot 24 by minimizing the possibility of the bunch of napkins becoming jammed in the slot. Also, the napkins in the bunch are permitted to sag at their center regions since the perimeter regions thereof are supported above the floor by the support tabs 34, 36. This minimizes any tendency for the napkin bunch to become jammed as it is being pulled out.

If desired, an additional ridge 32A can be provided adjacent the rear end of the floor 13 to support a rear end of the stack in case the loading of the stack causes the stack to be pushed downwardly past the support tabs 34, 36.

It will also be appreciated that the ridges 32, 32A serve to reinforce the floor 13.

The floor 13 includes side edges 40 that, like the front edge 28, could be offset inwardly with respect to lower ends of the side walls 16 (see FIG. 4).

The floor 13 can be provided with a center aperture 50 to enable napkins to be dispensed one-at-a-time therethrough if that is desired.

In practice, the dispenser 10 is fastened to a vertical surface, and a vertical stack of paper napkins is inserted into the compartment 15. Loading of the napkins is facilitated by the vertical slot 20 which accommodates a user's hand. The dispenser could be positioned at a drive-through station of a fast food restaurant where an operator bags a customer's order and hands it to him/her. One of the duties of the operator is to insert napkins, especially since the occupants of the vehicle may not have any other access to napkins. Hence, it is desired to supply the customer with a bunch of napkins.

Figure 8:
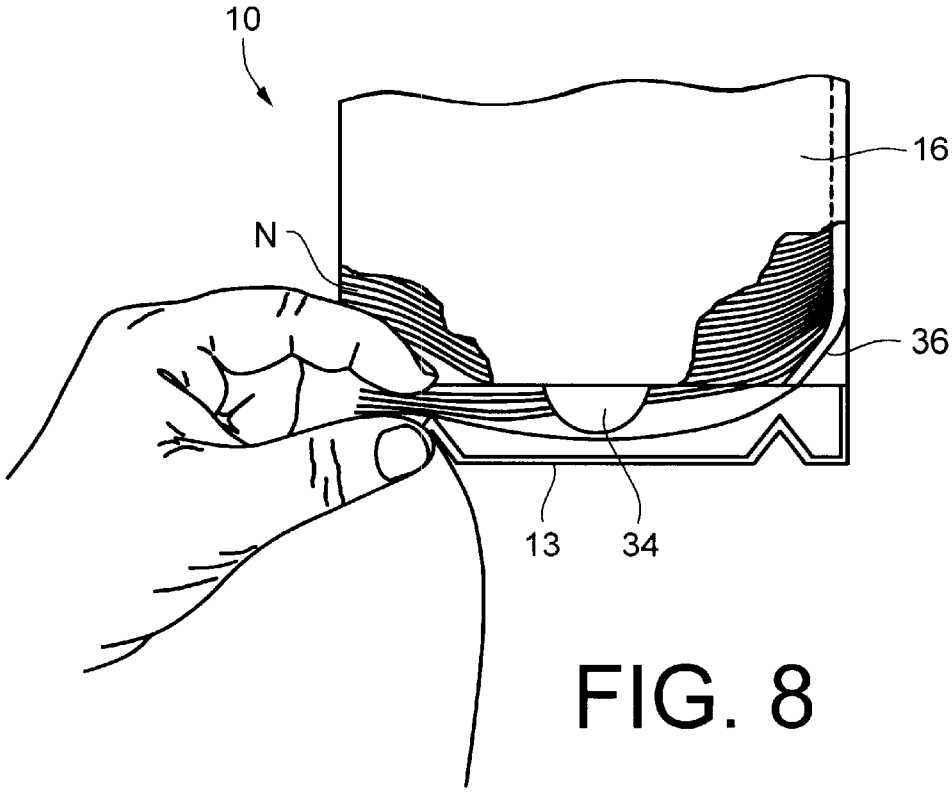
FIG. 8 is a view similar to FIG. 7 after a user has grasped the front portion of a bunch of napkins disposed in the dispenser.
Figure 9:
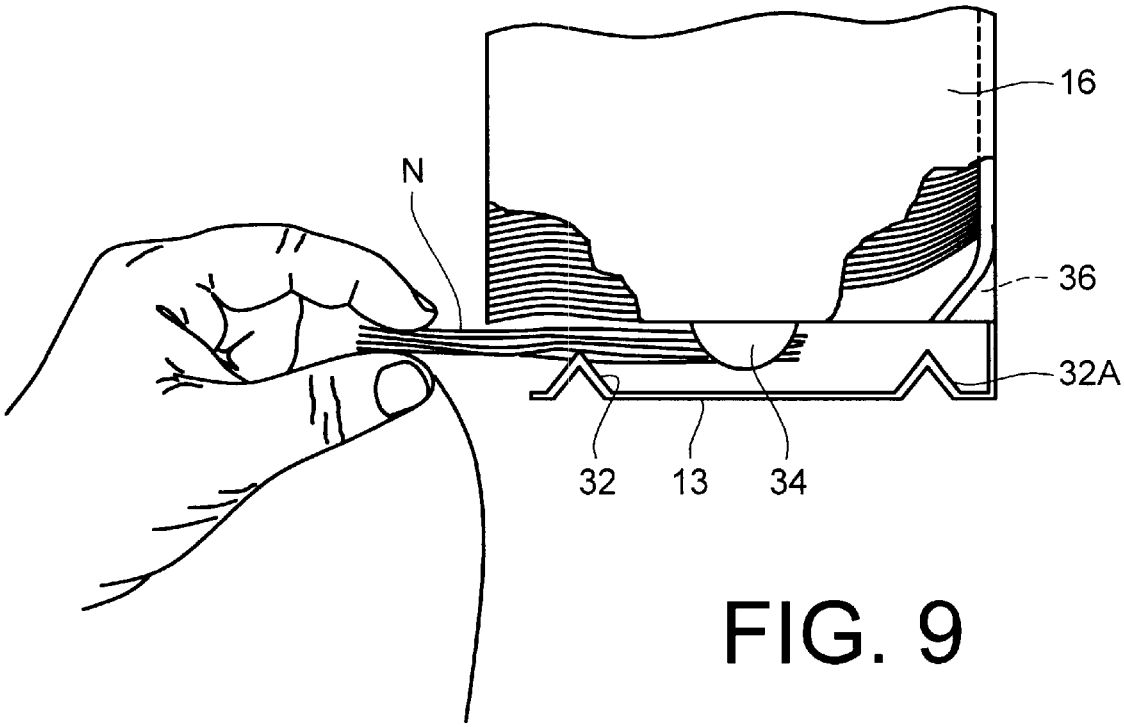
FIG. 9 is a view similar to FIG. 8 after the user has partially pulled out the bunch of napkins.

To do so, the user inserts one finger (e.g., a thumb) into a lower end of the vertical slot 20, and another finger (e.g., an index finger) into the recess 30 to pinch a bunch of napkins between those fingers, as shown in FIG. 8. Then the user pulls the bundle through the horizontal slot 24 and out of the dispenser as shown in FIG. 9. The slot 24 acts roughly as a metering device to somewhat limit the height of the bundle that can be dispensed.

Pulling the bundle from the dispenser is facilitated by the structural features of the dispenser, such as: (a) the supporting of napkins on the side and rear support tabs 34, 36 with the rear support tabs 34 situated higher than the side support tabs 36, (b) the front portion of the bundle supported on the ridge 32 of the floor, and (c) the front edge 28 of the floor 13 being offset horizontally inwardly relative to the lower end 22 of the front wall 14. That combination of features minimizes chances of the bundle becoming jammed or wedged while being pulled through the slot, and minimizes napkin tabbing.

The user is able to insert his thumb at a selected level whereby the user can select a desired number of napkins. Since the user is able to see, and gain access to, napkins disposed higher than an upper edge 22 of the horizontal slot 24, due to the presence of the vertical slot 20, the user is able to position his/her thumb over a napkin situated higher than the upper edge of the horizontal slot and squeeze and pull the resulting bunch through the slot 24. The amount of napkins that can be pulled through the slot 24 is limited by the height of the slot and the compressability of the napkins.

If it is necessary to remove a larger bunch of napkins, it could be removed from the top of the dispenser, since the vertical slot extends all the way to the top of the front wall 14.

In any event, a reasonable number of napkins could be removed through the slot 24, such as from one to about fifteen or twenty.

Figure 5:
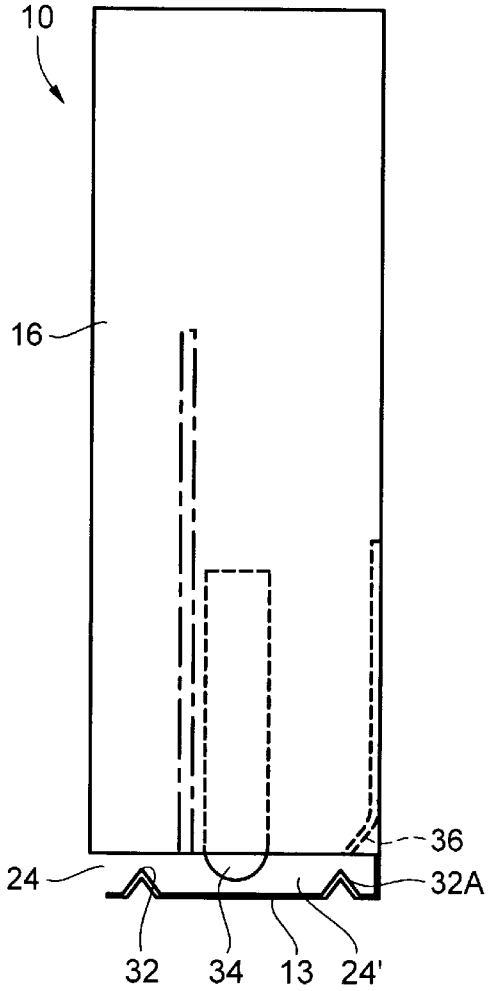
FIG. 5 is a side elevational view of the dispense.
Figure 6:
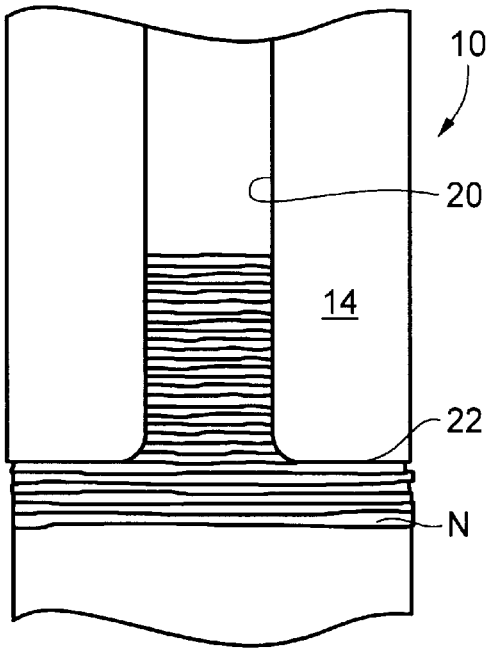
FIG. 6 is a front elevational view of the dispenser, with a stack of napkins disposed therein.

If desired, a slot 52 could be formed in either or both of the side walls 16, as shown in phantom lines in FIG. 5, to enable a user to see from a side view how many napkins are left in the dispenser.

Desirably, the dispenser is a high-capacity dispenser capable of holding at least about one-thousand napkins.

It will be appreciated that the invention provides an upright napkin dispenser which facilitates the dispensing of napkins by the bunch. Alternatively, napkins could be dispensed one-at-a-time through the slot 24 or the bottom aperture 50.

Although the present invention has been described in connection with a preferred embodiment thereof, it will be appreciated by those skilled in the art that additions, deletions, modifications, and substitutions not specifically desired may be made without departing from the spirit and scope of the invention as defined in the appended claims.

What is claimed is:

1. A napkin dispenser comprising a housing including upright walls and a floor together forming a vertical compartment for the reception of a vertical stack of horizontal paper napkins; the upright walls including a front wall; a horizontal slot formed between the floor and a lower end of the front wall, wherein the horizontal slot communicates with a lower portion of the compartment for facilitating the simultaneous removal of a bunch of napkins through the slot, wherein the floor includes a front edge situated below the horizontal slot; the front edge including a recess disposed about midway between opposite ends of the slot for facilitating the insertion of a user's finger beneath a bunch of napkins to be removed; wherein the front wall includes a vertical slot extending upwardly from the horizontal slot at a location about midway between opposite horizontal ends of the horizontal slot for facilitating the insertion of a user's finger above a bunch of napkins to be removed; wherein the vertical slot extends to an upper end of the front wall.

2. The dispenser according to claim 1 wherein the upright wall structure includes a pair of side walls forming respective sides of the housing, the side walls joined to the front walls; lower ends of the side walls spaced above the floor whereby the horizontal slot continues around both sides of the housing.

3. The dispenser according to claim 2 wherein the floor includes a front edge disposed below the lower end of the front wall and offset horizontally therefrom toward the rear wall.

4. The dispenser according to claim 3 wherein the floor includes side edges offset inwardly relative to lower ends of respective side walls.

5. The dispenser according to claim 4 wherein the bottom wall includes a downwardly opening aperture enabling napkins to be removed therethrough one-at-a-time.

6. The dispenser according to claim 5 wherein the floor includes an upright ridge extending parallel to the horizontal slot at a location adjacent the front edge of the floor.

7. The dispenser according to claim 6 further including a plurality of support tabs inclined downwardly and inwardly from the upright wall structure for supporting at least a portion of underside of the stack above the floor.

8. The dispenser according to claim 7 wherein the support tabs include side support tabs mounted on the side walls and rear support tabs mounted on the rear wall, the rear support tabs situated higher than the side support tabs.

9. The dispenser according to claim 1 wherein the upright walls include opposing side walls and a rear wall opposing the front wall, wherein the support tabs include side support tabs mounted on the side walls and rear support tabs mounted on the rear wall, the rear support tabs situated higher than the side support tabs.

10. A napkin dispenser comprising a housing including upright walls and a floor forming a vertical compartment for the reception of a vertical stack of horizontal paper napkins; the upright walls including a front wall, two opposing side walls, and a rear wall opposing the front wall; a lower end of the front wall spaced above the floor to define a horizontal slot disposed below the front wall and communicating with a lower portion of the compartment for facilitating the simultaneous removal of a bunch of napkins from the compartment; the floor including a front edge offset horizontally inwardly from the lower end of the front wall; the front edge having a recess formed therein at a location disposed about midway between opposite horizontal ends of the horizontal slot; the lower end of the front wall having a vertical slot formed therein at a location disposed about midway between opposite horizontal ends of the horizontal slot; the vertical slot extending to an upper end of the front wall; the recess and the vertical slot facilitating the insertion of a user's fingers beneath and above the stack, respectively; each of the side walls and the rear wall including a support tab structure inclined downwardly and inwardly for supporting at least a portion of an underside of the stack above the floor.

11. The dispenser according to claim 10 wherein the front edge of the floor is offset horizontally inwardly with respect to the lower end of the front wall; the support tab structure on the rear wall disposed higher than the support tab structure on the side walls.

12. A napkin dispenser comprising a housing including upright walls and a floor together forming a vertical compartment for the reception of a vertical stack of horizontal paper napkins; the upright walls including a front wall; a horizontal slot formed between the floor and a lower end of the front wall, wherein the horizontal slot communicates with a lower portion of the compartment for facilitating the simultaneous removal of a bunch of napkins through the slot; wherein the front wall includes a vertical slot extending upwardly from the horizontal slot at a location about midway between opposite horizontal ends of the horizontal slot for facilitating the insertion of a user's finger above a bunch of napkins to be removed; wherein the vertical slot extends to an upper end of the front wall.

13. A napkin dispenser comprising a housing including upright walls and a floor together forming a vertical compartment for the reception of a vertical stack of horizontal paper napkins; the upright walls including a front wall; a horizontal slot formed between the floor and a lower end of the front wall, wherein the horizontal slot communicates with a lower portion of the compartment for facilitating the simultaneous removal of a bunch of napkins through the slot; wherein the upright walls include a pair of side walls forming respective sides of the housing, the side walls joined to the front walls, lower ends of the side walls spaced above the floor whereby the horizontal slot continues around both sides of the housing.

14. A napkin dispenser comprising a housing including upright walls and a floor together forming a vertical compartment for the reception of a vertical stack of horizontal paper napkins; the upright walls including a front wall; a horizontal slot formed between the floor and a lower end of the front wall, wherein the horizontal slot communicates with a lower portion of the compartment for facilitating the simultaneous removal of a bunch of napkins through the slot; wherein the floor includes a front edge disposed below the lower end of the front wall and offset horizontally therefrom toward the rear wall.

15. A napkin dispenser comprising a housing including upright walls and a floor together forming a vertical compartment for the reception of a vertical stack of horizontal paper napkins; the upright walls including a front wall; a horizontal slot formed between the floor and a lower end of the front wall, wherein the horizontal slot communicates with a lower portion of the compartment for facilitating the simultaneous removal of a bunch of napkins through the slot; wherein the bottom wall includes a downwardly opening aperture enabling napkins to be removed therethrough one-at-a-time.

16. A napkin dispenser comprising a housing including upright walls and a floor together forming a vertical compartment for the reception of a vertical stack of horizontal paper napkins; the upright walls including a front wall; a horizontal slot formed between the floor and a lower end of the front wall, wherein the horizontal slot communicates with a lower portion of the compartment for facilitating the simultaneous removal of a bunch of napkins through the slot, a plurality of support tabs inclined downwardly and inwardly from respective ones of the upright walls for supporting at least a portion of an underside of the stack above the floor.

* * * * *